United States Patent [19]

Kasanami et al.

[11] Patent Number: 4,735,184

[45] Date of Patent: Apr. 5, 1988

[54] FUEL CONTROL APPARATUS FOR INTERNAL COMBUSTION ENGINE

[75] Inventors: Mitsuru Kasanami; Hideyuki Tamura, both of Yokohama, Japan

[73] Assignee: Nissan Motor Company, Limited, Japan

[21] Appl. No.: 57,961

[22] Filed: Jun. 3, 1987

[30] Foreign Application Priority Data

Jun. 4, 1986 [JP] Japan ..... 61-129972

[51] Int. Cl.[4] ..... F02D 41/06

[52] U.S. Cl. ..... 123/491; 123/179 L

[58] Field of Search ..... 123/179 G, 179 L, 491

[56] References Cited

U.S. PATENT DOCUMENTS 4,438,748 3/1984 Ikeura et al. ..... 123/491
4,478,194 10/1984 Yamato et al. ..... 123/491
4,582,036 4/1986 Kiuchi et al. ..... 123/491
4,628,886 12/1986 Onishi ..... 123/491
4,653,452 3/1987 Sawada et al. ..... 123/179 L X
4,681,079 7/1987 Kaneta ..... 123/491

FOREIGN PATENT DOCUMENTS 0008327 1/1982 Japan .

*Primary Examiner*—Willis R. Wolfe
*Attorney, Agent, or Firm*—Lowe, Price, LeBlanc, Becker & Shur

[57] ABSTRACT

An apparatus for controlling an internal combustion engine having starter switch. The apparatus includes a control circuit for calculating a value corresponding to the amount of fuel supplied to the engine in time during which the engine is starting. The calculated value is modified in a direction decreasing the amount of fuel supplied to the engine when the interval between the time when the starter switch is turned on and the time when the engine stalls is equal to or less than a predetermined value and the interval between the time when the engine stalls and the time when the starter switch is turned on is equal to or less than a predetermined value.

2 Claims, 3 Drawing Sheets

FUEL CONTROL APPARATUS FOR INTERNAL COMBUSTION ENGINE

BACKGROUND OF THE INVENTION

This invention relates to an apparatus for controlling an internal combustion engine and, more particularly, to an engine control apparatus for controlling the amount of fuel to the engine in time during which the engine is starting.

It is the current practice to ensure smooth engine starting operation by furnishing an extra charge of fuel to the engine each time a starter switch is operated, as disclosed, for example, in Japanese Patent Kokai No. 57-8327. One problem associated with such a practice is in that an over-enrich mixture is created in the engine, causing spark plug smolder and other disadvantage events in the engine if the starter switch is operated again in a short time to avoid engine stall. This problem stems from the fact that a part of the fuel supplied to the engine in response to the preceding operation of the starter switch is residual in the engine intake manifold when the engine stalls in a short time after the started switch is turned off and the residual fuel enters the engine cylinders along with the fuel supplied in response to the next operation of the starter switch.

In order to eliminate such a problem, it has been proposed to inhibit supply of fuel to the engine for a predetermined time after the starter switch is operated once. However, this creates another problem in that the operator cannot re-start the engine without waiting for the predetermined time even when the engine stalls after the starter switch operation.

SUMMARY OF THE INVENTION

It is, therefore, a main object of the invention to provide an improved apparatus for controlling the amount of fuel to an engine in time during which the engine is starting.

It is another object of the invention to provide a fuel control apparatus which permits a starter switch to operate again in a short time to avoid engine stall without creating an over-rich mixture to the engine.

There is provided, in accordance with the invention, an apparatus for controlling an internal combustion engine having a starter switch changeable from a first state to a second state for starting the engine, and means for controlling the amount of fuel supplied to the engine. The apparatus comprises means for calculating a value corresponding to a setting of the means for controlling the amount of fuel supplied to the engine in time during which the engine is starting, means for measuring a first time interval until the engine stalls after the starter switch changes to the first state, means for measuring a second time interval until the starter switch changes to the second state after the engine stalls, means for comparing the first and second time intervals with first and second predetermined values, respectively, and means for modifying the calculated value to decrease the amount of fuel supplied to the engine when the first time interval is equal to or less than the first predetermined value and the second time interval is equal to or less than the second predetermined value.

BRIEF DESCRIPTION OF THE DRAWINGS

The invention will be described in greater detail by reference to the following description taken in connection with the accompanying drawings, in which.

DETAILED DESCRIPTION OF THE INVENTION

Figure 1:
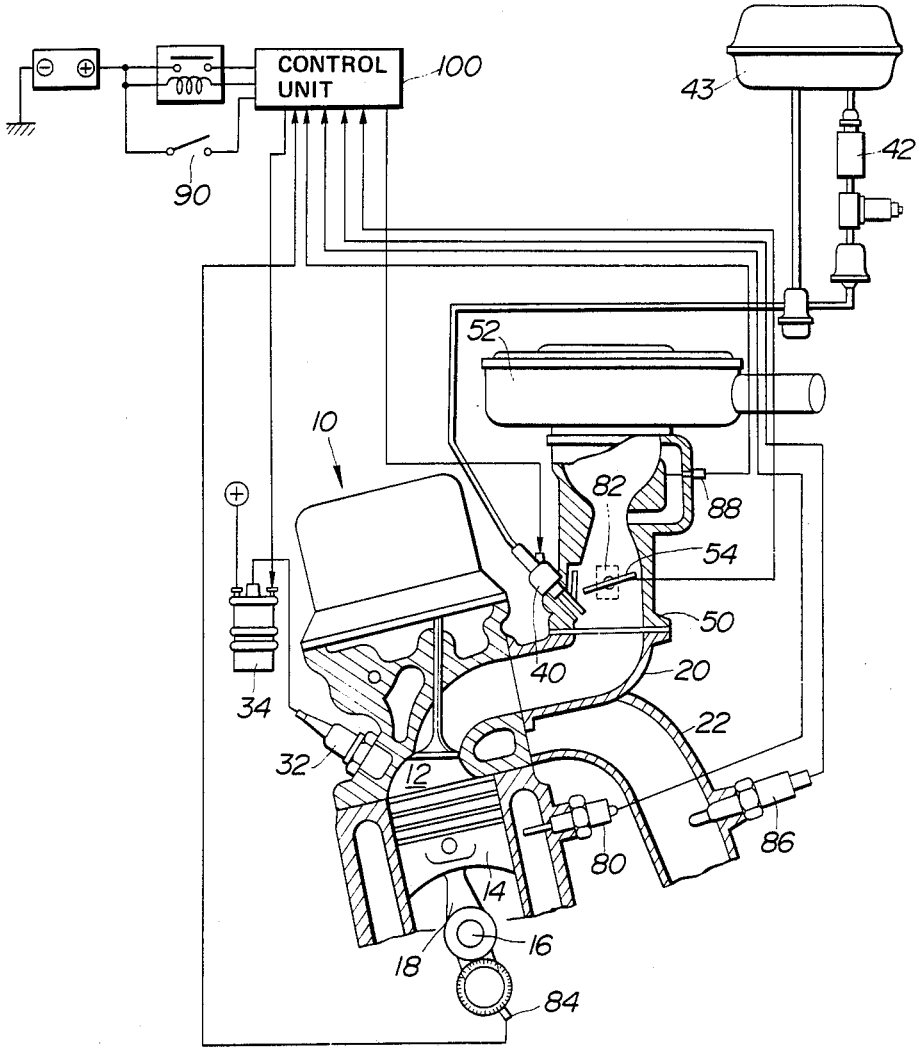
FIG. 1 is a schematic diagram showing one embodiment of a fuel control apparatus made in accordance with the invention.

With reference to the drawings, and in particular to FIG. 1, there is shown a schematic diagram of a fuel control apparatus embodying the invention. An internal combustion engine, generally designated by the numeral 10, for an automotive vehicle includes a combustion chamber or cylinder 12. A piston 14 is mounted for reciprocal motion within the cylinder 12. A crankshaft 16 is supported for rotation within the engine 10. Pivotally connected to the piston 14 and the crankshaft 16 is a connecting rod 18 used to produce rotation of the crankshaft 16 in response to reciprocation of the piston 16 within the cylinder 12.

An intake manifold 20 is connected with the cylinder 12 through an intake port with which an intake valve is in cooperation for regulating the entry of combustion ingredients into the cylinder 12 from the intake manifold 20. A spark plug 32 is mounted in the top of the cylinder 12 for igniting the combustion ingredients within the cylinder 12 when the spark plug 32 is energized by the presence of high voltage electrical energy from an ignition coil 34. An exhaust manifold 22 is connected with the cylinder 12 through an exhaust port with which an exhaust valve is in cooperation for regulating the exit of combustion products, exhaust gases, from the cylinder into the exhaust manifold 22. The intake and exhaust valves are driven through a suitable linkage with the crankshaft 16.

A fuel injector 40 is connected to a fuel pump 42 which is also connected to a fuel tank 43. The fuel pump 42 is electrically operated to maintain sufficient pressure. The fuel injector 40 opens to inject fuel into the intake manifold 20 when it is energized by the presence of electrical current. The length of the electrical pulse; that is, the pulse-width, applied to the fuel injector 40 determines the length of time the fuel injector 40 opens and, thus, determines the amount of fuel injected into the intake manifold 20. Air to the engine 10 is supplied through an air cleaner 52 into an induction passage 50. The amount of air permitted to enter the combustion chamber through the intake manifold 20 is controlled by a butterfly throttle valve 54 suitable within the induction passage 50. The throttle valve 54 is connected by a mechanical linkage to an accelerator pedal (not shown) which is manually controlled by the operator of the engine. The degree to which the accelerator pedal is depressed controls the degree of rotation of the throttle valve 54.

In the operation of the engine 10, fuel is injected through the fuel injector 40 into the intake manifold 20 and mixes with the air therein. When the intake valve opens, the air-fuel mixture enters the combustion chamber 12. An upward stroke of the piston 14 compresses the air-fuel mixture, which is then ignited by a spark produced by the spark plug 30 in the combustion chamber 12. Combustion of the air-fuel mixture in the combustion chamber 12 takes place, releasing heat energy, which is converted into mechanical energy upon the power stroke of the piston 14. At or near the end of the power stroke, the exhaust valve opens and the exhaust gases are discharged into the exhaust manifold 22.

The amount of fuel metered to the engine, this being determined by the width of the electrical pulse applied to the fuel injector 40, is repetitively determined from calculations performed by a digital computer based upon various conditions of the engine that are sensed during its operation. These sensed conditions include cylinder-head coolant temperature, throttle position, crankshaft position, exhaust oxygen content, intake air flow, and engine speed. Thus, a cylinder-head coolant temperature sensor 80, a throttle position sensor 82, a crankshaft position sensor 84, an oxygen sensor 86, and a flow meter 88 are connected to a control unit 100.

The cylinder-head coolant temperature sensor 80 preferably is mounted in the engine cooling system and comprises a thermistor connected in an electrical circuit capable of producing a DC voltage having a variable level proportional to coolant temperature. The throttle valve sensor 82 is a potentiometer electrically connected in a voltage divider circuit for supplying a DC voltage proportional to throttle valve position. The crankshaft position sensor 84 produces a series of crankshaft position electrical pulses each corresponding to one degree of rotation of the engine crankshaft 16 and a series of reference electrical pulses at a predetermined number of degrees before the top dead center position of each engine piston. The oxygen sensor 86 monitors the oxygen content of the exhaust and is effective to provide a signal indicative of the air-fuel ratio at which the engine is operating. The flow meter 88 is responsive to the air flow through a passage bypassing the induction passage 50 to produce a signal proportional thereto.

The control unit 100 includes a digital computer which includes a central processing unit (CPU), a random access memory (RAM), a read only memory, and an input/output control circuit. The central processing unit communicates with the rest of the computer via data bus. The input/output control circuit includes an analog-to-digital converter, a crankshaft position counter, and digital-to-analog converter. The analog-to-digital converter receives analog signals from the various sensors and it converts the received analog signals into corresponding digital signals for application to the central processing unit. The A to D conversion process is initiated on command from the central processing unit which selects the input channel to be converted. The crankshaft position counter counts the crankshaft position pulses. The read only memory contains the program for operating the central processing unit and further contains appropriate data in look-up tables used in calculating appropriate values for fuel delivery requirement. The look-up data may be obtained experimentally or derived empirically. A control word specifying a fuel delivery requirement, in the form of fuel-injection pulse-width and timing are periodically transferred by the central processing unit to the digital-to-analog converter (fuel injection control circuit) which converts it into a control signal for controlling the fuel injector 40. The digital compouter is responsive to an interrupt signal to temporarily stop execution of the program control sequence (background job) and to start executing an interrupt routine for controlling the fuel injector 40 during a specified operating condition.

The control unit 100 also receives a starter signal which is at a first level when a starter switch 90 is off and at a second level when it is turned on. The control unit 100 calculates a value corresponding to the amount of fuel which is supplied to the engine in response to an operator's operation of the starter switch. The control circuit 100 measures a first interval t1 between the time when the starter switch 90 is turned off and the time when the engine stalls and a second interval t2 between the time when the engine stalls and the time when the starter switch 90 is turned on. For this purpose, the control unit 100 includes first and second timers. The first timer may includes a counter advanced by one step at predetermined time intervals after the starter switch 90 is turned off to accumulate a count corresponding to the first time interval t1. The second timer may include a counter advanced by one step at predetermined time intervals after the engine stalls to accumulate a count corresponding to the second time interval t2. When the first time interval t1 is equal to or less than a first predetermined value T1 and the second time interval t2 is equal to or less than a second predetermined value T2, it is considered that a part of the fuel supplied to the engine in response to the preceding operation of the starter switch remains and, thus, the control unit 100 modifies the calculated value to decrease the amount of fuel supplied to the engine in response to the next starter switch operation. When the first time interval is greater than the first predetermined value T1 or when the second time interval t2 is greater than the second predetermined value T2, it is considered that the fuel supplied to the engine in response to the preceding starter switch operation is consumed and, thus, the control unit 100 holds the calculated value. According to the invention, therefore, it is possible to permit the next starter switch operation in a short time to avoid engine stall without creating an over-rich mixture in the engine.

Figure 2:
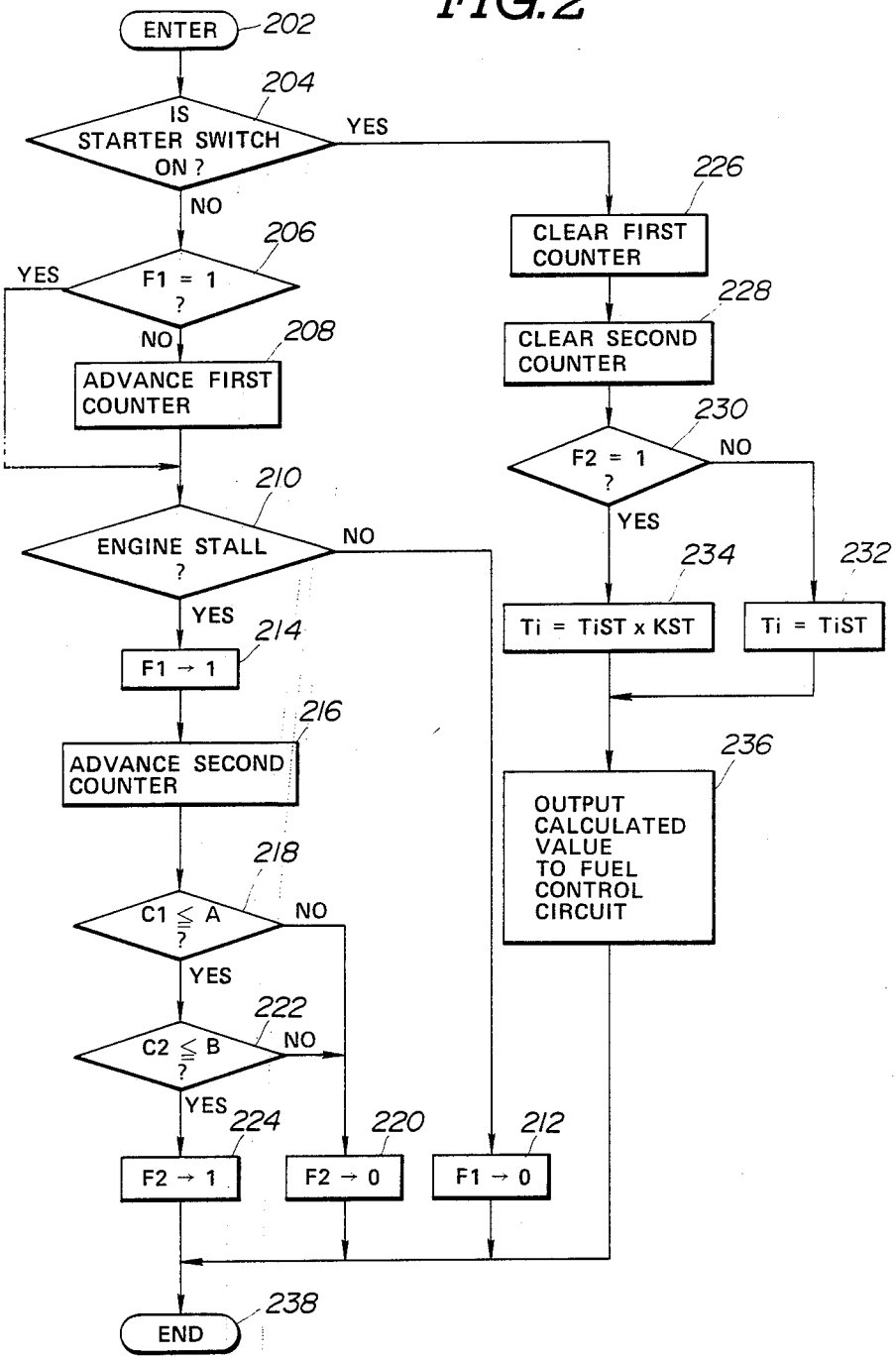
FIG. 2 is a flow diagram illustrating the programming of the digital computer as it is used to determine the amount of fuel supplied to the engine starting from rest.

FIG. 2 is a flow diagram illustrating the programming of the digital computer as it is used to determine the fuel-injection pulse-width for the engine starting from rest.

The computer program is entered at a point 202 at predetermined time intervals. At a point 204 in the program, a determination is made as to whether or not the starter switch 90 is on. If the answer to this question is "no", then the program proceeds to another determination step at a point 206. This determination is as to whether or not a first flag F1 is set. If the answer to this question is "no", then the program proceeds to a point 208 where the first counter is advanced by one step and the program proceeds to a point 210. Otherwise, the program jumps the step at the point 208 to the point 210. At the point 210, a determination is made as to whether or not the engine stalls. If the answer to this question is "no", the program proceeds to a point 212 where the first flag F1 is reset to zero. If the engine stalls, the program proceeds to a point 214 where the first flag is set to indicate that the engine stalls. Following this, the program proceeds to a point 216 where the second counter is advanced by one step and the program proceeds to a point 218.

At the point 218 in the program, a determination is made as to whether or not the first counter accumulates a count C1 equal to or less than a predetermined value A. If the answer to this question is "no", then it means that the time t1 lapsed after the starter switch 90 is turned on is greater than a predetermined value T1 and the program proceeds to a point 220 where a second flag F2 is cleared to zero. Otherwise, the program proceeds to another determination step at a point 222. This determination is as to whether or not the count C2 accumulated on the second counter is equal to or less than a predetermined value B. If the answer to this question is "no", then it means that the time t2 lapsed after the engine stalls is greater than a predetermined value T2 and the program proceeds to the point 220 where the second flag F2 is cleared to zero. Otherwise, the program proceeds to a point 224 where the second flag F2 is set to indicate that the starter switch 90 remains off for a time t1 equal to or less than the predetermined value T1 and the engine stall continues for a time t2 equal to or less than the predetermimed value T2. Following this, the program proceeds to the end point 238.

If the starter switch 90 is on at the point 204, then the program proceeds to a point 226 where the first counter is reset to zero and to a point 228 where the second counter is reset to zero. Following this, the program proceeds to a point 230 where a determination is made as to whether or not the second flag F2 is set. If the answer to this question is "no", when the program proceeds to a point 232 where the central processing unit calculates an appropriate value Ti for fuel-injection pulse-width from a relationship programmed into the computer. This relationship defines fuel-injection pulse-width as a function of engine speed and engine-coolant temperature. At a point 236, the calculated value Ti=-TiST for fuel-injection pulse-width is transferred to the fuel injection control circuit. The fuel injection control circuit then sets the fuel-injection pulse-width according to the calculated valve, causing the fuel injector 40 to supply fuel in an amount suitable for engine starting.

It the answer to the question inputted at the point 230 is "yes", then it means that the interval t1 between the time when the starter switch 90 is turned on and the time when the engine stalls is equal to or less than the predetermined value T1 and the interval t2 between the time when the engine stalls and the time when the starter switch 90 is turned off is equal to or less than the predetermined value T2 and the program proceeds to a point 234 where the central processing unit calculates an appropriate value Ti for fuel-injection pulse-width by multiplying a predetermined correction factor KST less than 1 by the value TiST calculated in the same manner as described in connection with the calculation step at the point 226. At the point 236, the modified value Ti=TiST×KST is transferred to the fuel injection control circuit. The fuel injection control circuit then sets the fuel-injection pulse-width according to the modified value, causing the fuel injector 40 to supply fuel in a smaller amount. Following this, the program proceeds to the end point 238.

Figure 3:
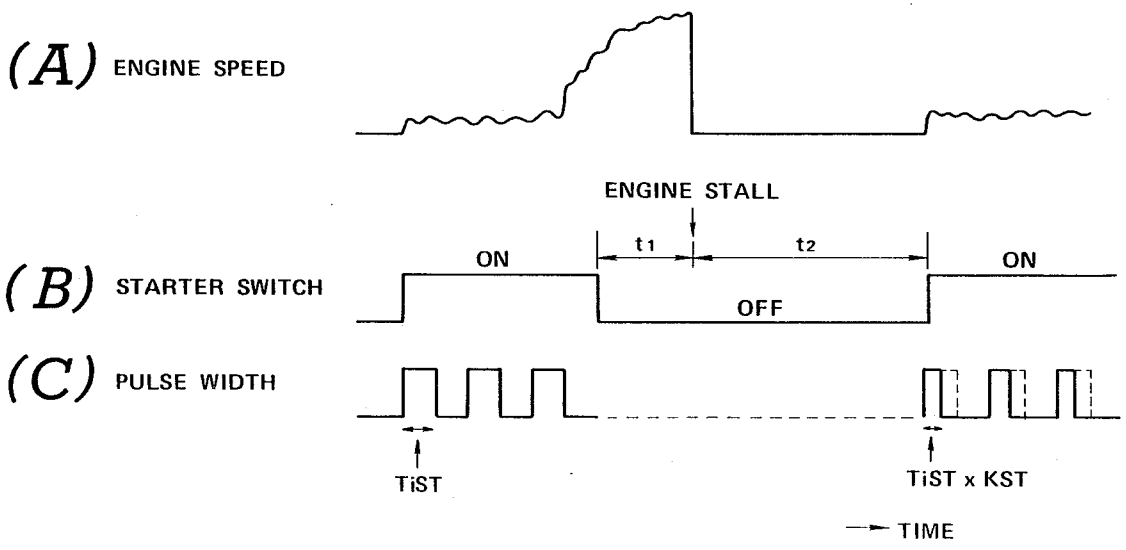
FIGS. 3A–3C contain waveforms obtained at several points of the fuel control apparatus.

Referring to FIG. 3, there is illustrated a typical case where the engine stalls in a time t1 shorter than a predetermined value T1 after the starter switch is turned off and the starter switch is turned on again in a time t2 shorter than a predetermined value T2 after the engine stalls. In this case, the inventive apparatus furnishes a smaller amount of fuel to the engine in response to the next operation of the starter switch than is furnished in response to the preceding starter switch operation. This permits the next starter switch operation in a short time to avoid engine stall without creating an over-rich mixture in the engine.

What is claimed is:

1. An apparatus for controlling an internal combustion engine having a starter switch changable from a first state to a second state for starting the engine, and means for controlling the amount of fuel supplied to the engine, comprising:

means for calculating a value corresponding to a setting of the means for controlling the amount of fuel supplied to the engine in time during which the engine is starting;

means for measuring a first time interval until the engine stalls after the starter switch changes to the first state;

means for measuring a second time interval until the starter switch changes to the second state after the engine stalls;

means for comparing the first and second time intervals with first and second predetermined values, respectively; and means for modifying the calculated value to decrease the amount of fuel supplied to the engine when the first time interval is equal to or less than the first predetermined value and the second time interval is equal to or less than the second predetermined value.

2. The apparatus as claimed in claim 1, wherein the modifying means includes means for multiplying the calculated value by a predetermined value less than 1.

* * * * *